US008818240B2

(12) United States Patent
Murakami

(10) Patent No.: US 8,818,240 B2
(45) Date of Patent: Aug. 26, 2014

(54) TRANSFER DEVICE

(75) Inventor: Susumu Murakami, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 117 days.

(21) Appl. No.: 13/583,418

(22) PCT Filed: Jan. 31, 2011

(86) PCT No.: PCT/JP2011/051867

§ 371 (c)(1),
(2), (4) Date: Sep. 7, 2012

(87) PCT Pub. No.: WO2011/111437

PCT Pub. Date: Sep. 15, 2011

(65) Prior Publication Data

US 2013/0022380 A1 Jan. 24, 2013

(30) Foreign Application Priority Data

Mar. 8, 2010 (JP) ..... 2010-050199

(51) Int. Cl.
*G03G 15/08* (2006.01)

(52) U.S. Cl.
USPC ..... 399/121; 399/297; 399/298; 399/301; 399/302

(58) Field of Classification Search
USPC ..... 399/68, 107, 110, 121, 297–302
See application file for complete search history.

(56) References Cited

U.S. PATENT DOCUMENTS 6,477,348 B2 * 11/2002 Miyamoto et al. ..... 399/299
7,558,509 B2 * 7/2009 Konishi ..... 399/167
7,848,687 B2 * 12/2010 Iwasaki ..... 399/301
7,903,992 B2 * 3/2011 Sakabe ..... 399/82
2005/0185991 A1 8/2005 Iwakura et al.
2007/0059050 A1 3/2007 Ishida
2009/0148202 A1 6/2009 Aiba

FOREIGN PATENT DOCUMENTS

| | | |
|---|---|---|
| JP | 2002-365928 | 12/2002 |
| JP | 2005-234229 | 9/2005 |
| JP | 2006-350254 | 12/2006 |
| JP | 2007-078750 | 3/2007 |
| JP | 2008-151976 | 7/2008 |
| JP | 2008-298835 | 12/2008 |
| JP | 2009-139670 | 6/2009 |
| JP | 2009-169273 | 7/2009 |

OTHER PUBLICATIONS

International Search Report for PCT/JP2011/051867 mailed Mar. 1, 2011.

* cited by examiner

*Primary Examiner* — Hoan Tran
(74) *Attorney, Agent, or Firm* — Nixon & Vanderhye, P.C.

(57) ABSTRACT

A Transfer device (10) includes an intermediate transfer belt (41), a plurality of intermediate transfer roller (34A-34D) and a transfer member moving mechanism (20). The transfer member moving mechanism moves the intermediate transfer rollers (34A-34D) between pressing positions causing the intermediate transfer belt (41) to be pressed against respective photoreceptor drums (31A-31D) and separate positions causing the intermediate transfer belt (41) to be separate from the respective photoreceptor drums (31A-31D). The transfer member moving mechanism (20) causes a second pressing position of the intermediate transfer roller for monochrome (34A) in monochromatic image forming to be different from a first pressing position of the intermediate transfer roller for monochrome (34A) in full-color image forming so that an amount of pressing of the intermediate transfer belt (41) by the intermediate transfer roller for monochrome (34A) becomes greater in monochromatic image forming than in full-color image forming.

3 Claims, 10 Drawing Sheets

FIG. 5

| OFFSET VALUE F (mm) | STATE OF CONTACT | IMAGE QUALITY | | | |
|---|---|---|---|---|---|
| | | YELLOW | CYAN | MAGENTA | BLACK |
| 0.0 | CONTACT | × | × | × | × |
| 0.5 | CONTACT | ○ | × | × | × |
| 1.0 | CONTACT | ◎ | × | × | × |
| 1.5 | CONTACT | ○ | × | × | × |
| 2.0 | NON-CONTACT | ○ | ○ | ○ | ○ |
| 2.5 | NON-CONTACT | ○ | ○ | ○ | ○ |
| 3.0 | NON-CONTACT | ○ | ◎ | ◎ | ◎ |
| 3.5 | NON-CONTACT | ○ | ○ | ○ | ○ |
| 4.0 | NON-CONTACT | ○ | ○ | ○ | ○ |

TRANSFER DEVICE

This application is the U.S. national phase of International Application No. PCT/JP2011/051867 filed 31 Jan. 2011 which designated the U.S. and claims priority to JP 2010-050199 filed 8 Mar. 2010, the entire contents of each of which are hereby incorporated by reference.

TECHNICAL FIELD

The present invention relates to a transfer device that transfers a developer image formed in accordance with the electrophotography method onto a recording medium through an endless belt.

BACKGROUND ART

A tandem-type full-color image forming apparatus provided with a plurality of image bearing members respectively bearing developer images of different hues includes a transfer device to transfer an image onto a recording medium through an endless belt (for example, refer to the Patent Literature 1). The endless belt is installed in the image forming apparatus in such a manner that a predetermined region of its outer circumferential surface faces the plurality of image bearing members. The transfer device includes a plurality of transfer members opposed to the plurality of image bearing members across the endless belt.

In such a transfer device, when a monochromatic image forming is performed, the transfer member for monochrome is caused to approach the image bearing member for monochrome while the transfer members for color are caused to be separate from the respectively corresponding image bearing members for color. This causes the endless belt to come into contact with the image bearing member for monochrome, while causing it not to come into contact with the image bearing members for color. Then, when a full-color image forming is performed, the transfer member for monochrome and the transfer members for color are respectively caused to approach the respective plurality of corresponding image bearing members. This causes the endless belt to come into contact with all the image bearing members.

Application of a transfer bias to the transfer members corresponding to the image bearing members that have come into contact with the endless belt causes the developer images to be transferred from the respective image bearing members onto the endless belt.

CITATION LIST

Patent Literature

[Patent Literature 1]
Japanese Patent Unexamined Publication No. 2005-234229 bulletin

SUMMARY OF INVENTION

Technical Problem

However, whereas the transfer members for color approach the image bearing members for color in full-color image forming, they are separate from the image bearing members for color in monochromatic image forming. As a result, a degree of angle of approach of the endless belt to the image bearing member becomes larger in monochromatic image forming than in full-color image forming. Therefore, in conventional transfer device, a nip width between the image bearing member for monochrome and the endless belt becomes smaller in monochromatic image forming than in full-color image forming. A difference in the nip breadth results in a difference in image quality of a monochromatic image between cases in monochromatic image forming and in full-color image forming.

The present invention is directed to providing a transfer device capable of forming a monochromatic image of equal image quality in monochromatic image forming and in full-color image forming.

Solution to Problem

The present invention concerns a transfer device in which an outer circumferential surface of an endless belt moving along a predetermined loop-like path of movement is disposed so as to face a plurality of image bearing members including one image bearing member for monochrome and one or more image bearing members for color that bear developer images of mutually different hues and are aligned with each other. The transfer device includes the endless belt, a plurality of transfer members and a transfer member moving mechanism. The plurality of transfer members, being disposed so as to be opposed to the respective plurality of image bearing members across the endless belt on respective downstream sides of the plurality of image bearing members in the direction of movement of the endless belt, sequentially transfer the developer images borne by the respective plurality of image bearing members onto the endless belt. The transfer member moving mechanism moves the plurality of transfer members between pressing positions to cause the endless belt to be pressed against the respective plurality of image bearing members and separate positions to cause the endless belt to be separate from the respective plurality of image bearing members. The transfer member moving mechanism arranges the transfer member for monochrome corresponding to the image bearing member for monochrome and the transfer members for color corresponding to the image bearing members for color at the respective pressing positions in full-color image forming, and arranges the transfer member for monochrome at the pressing position while arranging the transfer members for color at the separate positions in monochromatic image forming. The transfer member moving mechanism causes a second pressing position of the transfer member for monochrome in monochromatic image forming to be different from a first pressing position of the transfer member for monochrome in full-color image forming so that an amount of pressing of the endless belt by the transfer member for monochrome becomes greater in monochromatic image forming than in full-color image forming.

In this configuration, the transfer members for color are disposed at the separate positions in monochromatic image forming, whereas they are disposed in the pressing positions in full-color image forming. As a result, the degree of angle of approach of the endless belt to the image bearing member becomes larger in monochromatic image forming than in full-color image forming.

Further, because the transfer members are disposed on the respective downstream sides of the plurality of image bearing members in the direction of movement of the endless belt, it is possible for the transfer members to cause the endless belt to be pressed against the image bearing members without the transfer members' coming into contact with the image bearing members across the endless belt with pressure.

Thus, with the second pressing position of the transfer member for monochrome in monochromatic image forming caused to be different from the first pressing position of the transfer member for monochrome in full-color image forming so that the amount of pressing of the endless belt by the transfer member for monochrome becomes greater in monochromatic image forming than in full-color image forming, the nip width between the image bearing member for monochrome and the endless belt in monochromatic image forming can be increased. Therefore, the nip width between the image bearing member for monochrome and the endless belt can be made the same in full-color image forming and in monochromatic image forming.

Advantageous Effects of Invention

The present invention allows for forming a monochromatic image of equal image quality in monochromatic image forming and in full-color image forming.

BRIEF DESCRIPTION OF DRAWINGS

FIG. 5 is a diagram showing experimental data on relationships between offset values and image quality of respective hues.

DESCRIPTION OF EMBODIMENTS

Figure 1:
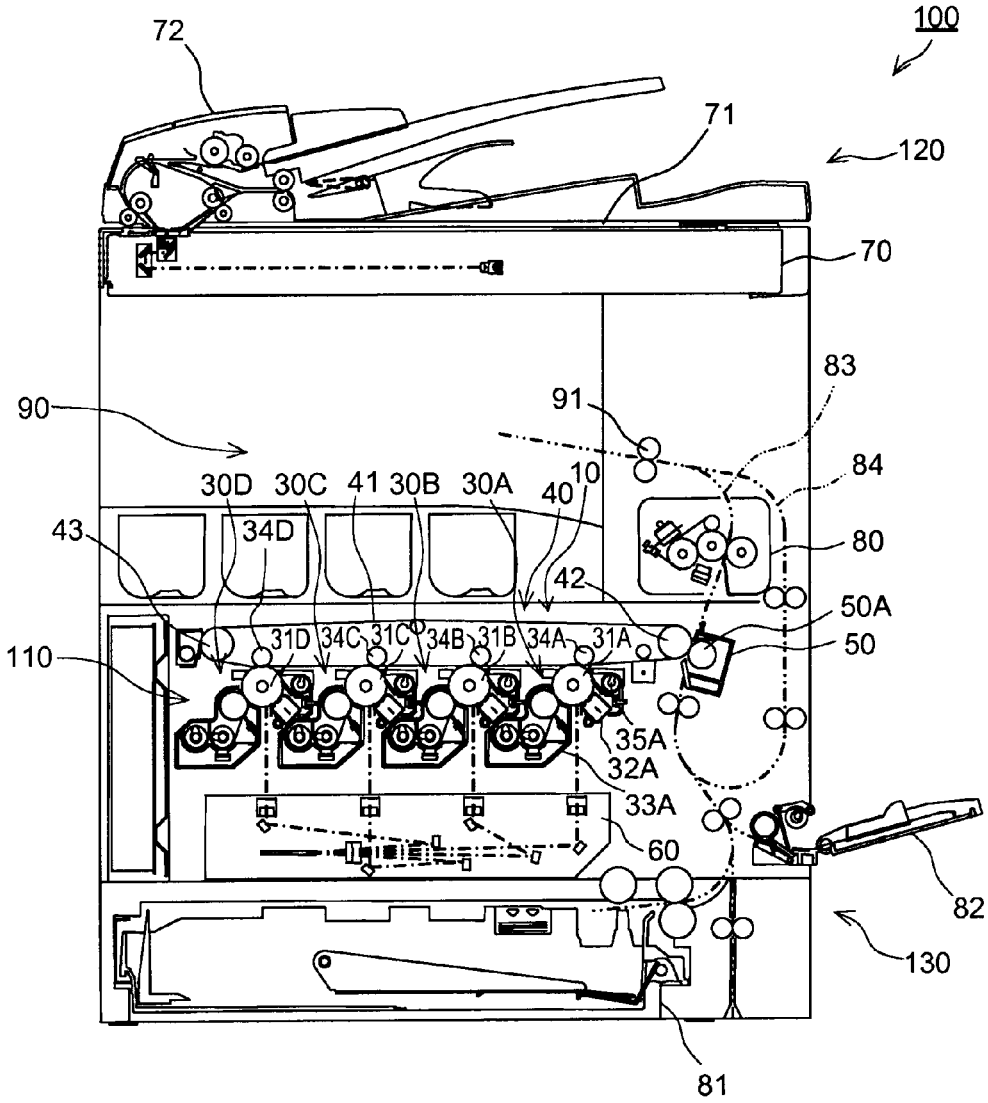
FIG. 1 is a general front sectional view of an image forming apparatus provided with a transfer device according to an embodiment of the present invention.

Below, an image forming apparatus 100 provided with a transfer device 10 according to an embodiment of the present invention is explained referring to the drawings.

As shown in FIG. 1, the image forming apparatus 100 forms a multicolor or monochromatic image on a predetermined paper sheet (recording medium) based on image data read from a document. To that end, the image forming apparatus 100 has an image reading unit 120 in an upper part of a main body, and has an image forming section 110 and a paper feeding section 130 in an inner part of the main body.

The image reading unit 120 includes a scanner unit 70, a document table 71 and an automatic document feeder 72. The scanner unit 70 reads image data from an image plane of the document disposed on a top surface of the document table 71 at the time of copying in operation. The document table 71 is made of rigid sheet glass, and is installed on the top surface of the main body of the image forming apparatus 100. The top surface of the document table 71 is capable of being opened and shut by the automatic document feeder 72. The automatic document feeder 72 conveys the documents disposed on a document load tray to a paper receiving tray piece by piece. In the course of the conveyance, the scanner unit 70 reads the image data from the image plane of the document.

The image forming section 110 includes an intermediate transfer belt unit 40, image forming stations 30A through 30D, a secondary transfer unit 50, an exposure unit 60 and a fuser unit 80.

The intermediate transfer belt unit 40 includes an intermediate transfer belt 41 which is an endless belt, a drive roller 42 and an idle roller 43. Over the drive roller 42 and the idle roller 43 is rotatably passed the intermediate transfer belt 41 with tension. The intermediate transfer belt 41 is formed using a film of thickness around 60 μm-150 μm.

The image forming stations 30A through 30D are provided with a plurality of photoreceptor drums (image bearing members) that bear toner images (developer images) of mutually different hues, where the plurality of photoreceptor drums includes one photoreceptor drum for monochrome (image bearing member for monochrome) bearing a developer for black, and one or more photoreceptor drums for color (image bearing members for color) bearing the one or more developers for color.

In the embodiment, the image forming stations 30A through 30D respectively perform image forming processes in accordance with the electrophotography method using developers of respective hues consisting of black, cyan, magenta and yellow. The image forming stations 30B through 30D are configured in the same manner as the image forming station 30A. The image forming stations 30A through 30D are aligned with each other in a direction of movement (sub scanning direction) of the intermediate transfer belt 41. For example, the image forming station 30A has, around the photoreceptor drum 31A, an electrostatic charger 32A, a developing device 33A, an intermediate transfer roller 34A and a cleaning device 35A. Respective intermediate transfer rollers of the image forming stations 30A through 30D constitute the transfer members.

The intermediate transfer belt unit 40 and the respective intermediate transfer rollers of the image forming stations 30A through 30D are included in the transfer device 10. The transfer device 10 is disposed in such a manner that an outer circumferential surface of the intermediate transfer belt 41 faces the respective photoreceptor drums 31A through 31D.

The intermediate transfer roller 34A is produced from a metal (for example, stainless steel) shaft having a diameter of 8 to 10 mm, with the surface thereof coated with an electrically-conductive elastomer (for example, EPDM, urethane foam). The intermediate transfer roller 34A is disposed so as to be opposed to the corresponding photoreceptor drum 31A across the intermediate transfer belt 41. The intermediate transfer roller 34A applies a high voltage uniformly to the intermediate transfer belt 41 through the electrically-conductive elastomer. The intermediate transfer roller 34A is configured so as to move, in relation to the photoreceptor drum 31A, toward a direction that is different from the direction normal to a circumferential surface, that is to say, the radial direction, of the photoreceptor drum 31A.

The exposure unit 60 drives a semiconductor laser based on the image data read by the image reading unit 120 on the respective hues of black, cyan, magenta and yellow, and distributes laser beams for the respective hues to the image forming stations 30A through 30D. The exposure unit 60 may be one that uses a light source other than semiconductor laser, for example, a LED array or the like that is driven based on the image data.

For example, at the image forming station 30A, the circumferential surface of the photoreceptor drum 31A is uniformly charged by the electrostatic charger 32A; and thereafter, it is exposed by the laser beam that is distributed from the exposure unit 60 based on the black image data. This results in the formation of an electrostatic latent image based on the black image data on the circumferential surface of the photoreceptor drum 31A. Subsequently, to the circumferential surface of the photoreceptor drum 31A is supplied the developer for black from the developing device 33A, thereby rendering the electrostatic latent image visible in a black toner image. The toner image formed on the circumferential surface of the photoreceptor drum 31A is transferred onto the outside circumferential surface of the intermediate transfer belt 41 by the intermediate transfer roller 34A to which a primary transfer bias of a polarity (for example, plus) reverse to the electrostatic charge polarity (for example, minus) of the toner is applied. The toner remaining on the circumferential surface of the photoreceptor drum 31A is removed by the cleaning device 35A.

In monochromatic image forming, the above mentioned image forming process is performed only at the image forming station 30A for monochrome. Then, in full-color image forming, the same image forming processes as the one at the image forming station 30A are performed at the image forming stations 30B through 30D on the respective hues of cyan, magenta and yellow, in addition to the image forming station 30A. By the primary transfer bias applied to the respective intermediate transfer rollers 34A through 34D of the image forming stations 30A through 30D, the toner images of the respective hues consisting of black, cyan, magenta and yellow are sequentially transferred onto the outer circumferential surface of the intermediate transfer belt 41, thereby being superimposed to a single toner image.

The paper feeding section 130 includes a paper feed cassette 81, a hand-fed paper tray 82, a main paper conveying path 83 and a secondary paper conveying path 84. To the paper feed cassette 81 are received a plurality of paper sheets of size and kind with a relatively high frequency in use. Onto the hand-fed paper tray 82 are placed one or more paper sheets of size and kind with a relatively low frequency in use.

The main paper conveying path 83 is formed from the paper feed cassette 81 and the hand-fed paper tray 82 through a space between the intermediate transfer belt 41 and the secondary transfer unit 50, and then by way of the fuser unit 80 to a paper discharge section 90.

The secondary transfer unit 50 has a secondary transfer roller 50A, and the toner image borne on the outside circumferential surface of the intermediate transfer belt 41 is transferred onto a paper sheet by the secondary transfer roller 50A to which a secondary transfer bias of a polarity (+) reverse to the electrostatic charge polarity (−) of the toner is applied. The secondary transfer unit 50 is included in the transfer device 10.

The fuser unit 80 fixes the toner image on the paper sheet by heating and pressing the paper sheet onto which the toner image heat has been transferred.

Here, for the purpose of maintaining a nip pressure between the secondary transfer roller 50A of the secondary transfer unit 50 and the intermediate transfer belt 41 at a predetermined value, either one of the secondary transfer roller 50A and the drive roller 42 is made of a rigid material (such as metal), and the other one is made of a soft material having elasticity (rubber roller or foam resin roller).

The secondary paper conveying path 84 is formed from a position between the fuser unit 80 and a paper discharge roller 91 in the main paper conveying path 83 to the upstream side of the secondary transfer unit 50. The secondary paper conveying path 84 is used when images are to be formed on both faces of a paper sheet to introduce the paper sheet, of which front and back edges are turned by the paper discharge roller 91 with its first face having undergone an image forming and having passed through the fuser unit 80, into the space between the intermediate transfer belt 41 and the secondary transfer roller 50A.

Subsequently, referring to FIG. 2 through FIG. 4, relations in arrangement between the photoreceptor drums 31A through 31D and the intermediate transfer rollers 34A through 34D in the image forming section 110 is explained.

As shown in FIG. 2, the intermediate transfer belt 41 is passed over the drive roller 42 and the idle roller 43 with tension, and moves along a predetermined loop-like path of movement. Along the outer circumferential surface of the intermediate transfer belt 41 are disposed the photoreceptor drum 31D, the photoreceptor drum 31C, the photoreceptor drum 31B and the photoreceptor drum 31A in this order from the upstream side in the direction of movement C of the intermediate transfer belt 41. As an example, the drive roller 42 is disposed on a side near to the photoreceptor drum 31A, and the idle roller 43 is disposed on a side near to the photoreceptor drum 31D. The intermediate transfer rollers 34A through 34D are disposed at positions opposed to the respective photoreceptor drums 31A through 31D across the intermediate transfer belt 41. In the embodiment, the intermediate transfer belt 41 is disposed above the photoreceptor drums 31A through 31D.

Figure 2A:
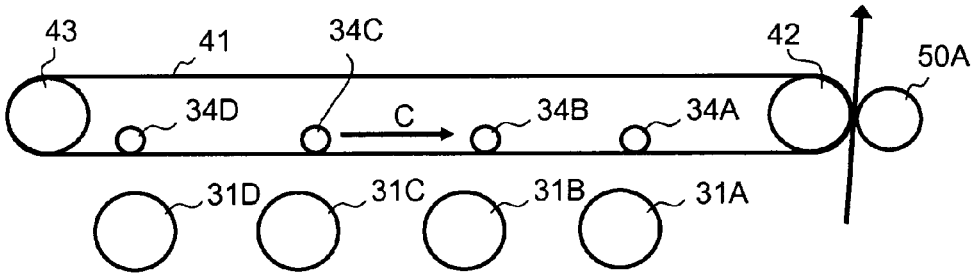
FIG. 2 is a drawing showing relations in arrangement between photoreceptor drums and intermediate transfer rollers; with FIG. 2A showing the relation in arrangement in non-image forming.
FIG. 2B showing the relation in arrangement in monochromatic image forming.
FIG. 2C showing the relation in arrangement in full-color image forming.

As shown in FIG. 2A, assuming that the direction of movement C of the intermediate transfer belt 41 in non-image forming is in a horizontal direction, the bottoms of the drive roller 42 and the idle roller 43 and the bottoms of the intermediate transfer rollers 34A through 34D are disposed on a single straight line in non-image forming. The bottoms of the drive roller 42 and the idle roller 43 are disposed upward from the tops of the photoreceptor drums 31A through 31D.

The intermediate transfer rollers 34A through 34D are configured so as to be movable between pressing positions that cause the intermediate transfer belt 41 to be pressed against the respective photoreceptor drums 31A through 31D and separate positions that cause the intermediate transfer belt 41 to be separate from the respective photoreceptor drums 31A through 31D by means of transfer member moving mechanism 20 (refer to FIG. 8). Detailed configuration of the transfer member moving mechanism 20 will be described later.

As an example, the intermediate transfer rollers 34A through 34D are configured so as to be movable in the vertical direction perpendicular to the direction of movement C of the intermediate transfer belt 41 in non-image forming, and get close to or away from the respective opposite photoreceptor drums 31A through 31D. In other words, the intermediate transfer rollers 34A through 34D cause the intermediate transfer belt 41 to come into contact with the photoreceptor drums 31A through 31D with pressure by approaching the photoreceptor drums 31A through 31D, and cause the intermediate transfer belt 41 to be separate from the photoreceptor drums 31A through 31D by separating from the photoreceptor drums 31A through 31D.

The intermediate transfer rollers 34A through 34D are disposed so as to be opposed to the respective plurality of photoreceptor drums 31A through 31D across the intermediate transfer belt 41 on the respective downstream sides of the plurality of the photoreceptor drums 31A through 31D in the direction of movement C of the intermediate transfer belt 41. In more detail, rotating shafts of the intermediate transfer rollers 34A through 34D are disposed on the downstream sides of rotating shafts of the respective opposite photoreceptor drums 31A through 31D in the direction of movement C of the intermediate transfer belt 41.

As shown in FIG. 2A, in non-image forming, all of the intermediate transfer rollers 34A through 34D are respectively disposed at the separate positions, and the intermediate transfer belt 41 is separate from the photoreceptor drums 31A through 31D. In the non-image forming, the rotating shafts of the photoreceptor drums 31A through 31D are arranged in one line, and the rotating shafts of the intermediate transfer rollers 34A through 34D are also arranged in one line; and a direction of arrangement of the rotating shafts of the photoreceptor drums 31A through 31D and a direction of arrangement of the rotating shafts of the intermediate transfer rollers 34A through 34D become parallel to the direction of movement C of the intermediate transfer belt 41.

Figure 2B:
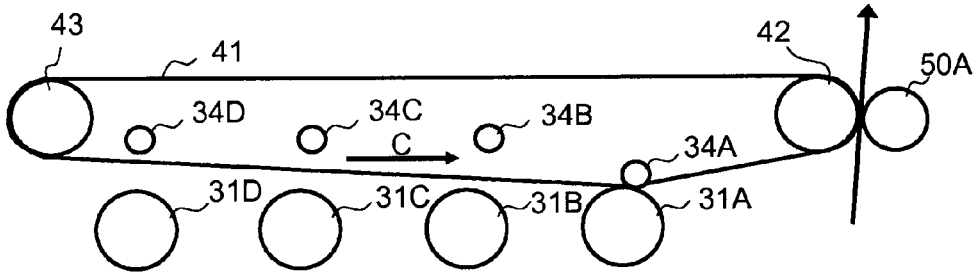

As shown in FIG. 2B, in monochromatic image forming, the intermediate transfer roller for monochrome (transfer member for monochrome) 34A is disposed at the pressing position, thereby causing the intermediate transfer belt 41 to come into contact with the photoreceptor drum 31A with pressure. On the other hand, the intermediate transfer rollers for color (transfer members for color) 34B through 34D are disposed at the respective separate positions, thereby causing the intermediate transfer belt 41 to be separate from the photoreceptor drums 31B through 31D.

In this case, the intermediate transfer belt 41 comes into contact with the photoreceptor drum 31A from a direction inclining downward from the upstream side to the downstream side in the direction of movement C of the intermediate transfer belt 41; however, because a distance in the horizontal direction between the idle roller 43 over which the intermediate transfer belt 41 is passed with tension on the upstream side in the direction of movement C and the photoreceptor drum 31A is longer as compared with the cases of the other photoreceptor drums 31B through 31D, a degree of angle of approach of the intermediate transfer belt 41 to the photoreceptor drum 31A becomes small. As a result, a nip pressure between the photoreceptor drum 31A and the intermediate transfer belt 41 becomes steady, and a transfer can be performed in a state where the nip pressure between the photoreceptor drum 31A and the intermediate transfer belt 41 is low. Accordingly, the occurrence of a transfer failure such as missing character due to the toner aggregation on the intermediate transfer belt 41 is suppressed, and hence the deterioration of image quality in the secondary transfer step is suppressed.

Here, the degree of angle of approach of the intermediate transfer belt 41 means a degree of angle to the direction of movement C of the intermediate transfer belt 41 in a range from the intermediate transfer roller 34A to the intermediate transfer roller 34D in full-color image forming. In addition to the above, the direction of movement C of the intermediate transfer belt 41 in the range from the intermediate transfer roller 34A to the intermediate transfer roller 34D is parallel to each other in full-color image forming and in non-image forming.

In monochromatic image forming, the toner image undergoes a primary transfer from the photoreceptor drum 31A onto the intermediate transfer belt 41 moving toward the direction of movement C by the primary transfer bias applied to the intermediate transfer roller 34A. Then, when a paper sheet passes the space between the drive roller 42 and the secondary transfer roller 50A, the toner image undergoes a secondary transfer from the intermediate transfer belt 41 onto the paper sheet by the secondary transfer bias applied to the secondary transfer roller 50A.

Figure 2C:
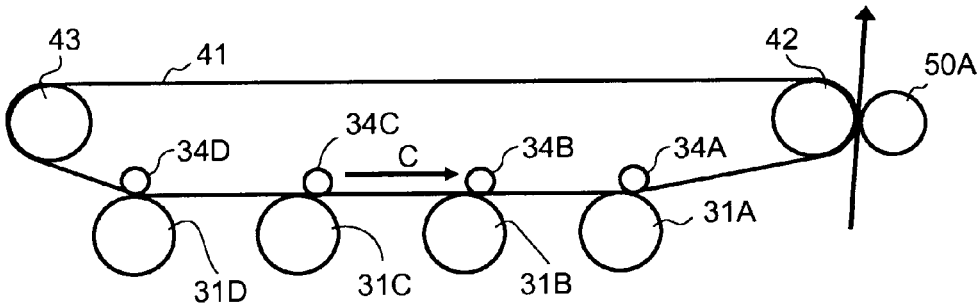

As shown in FIG. 2C, in full-color image forming, the intermediate transfer roller for monochrome 34A and the intermediate transfer rollers for color 34B through 34D are disposed at the respective pressing positions, thereby causing the intermediate transfer belt 41 to come into contact with the photoreceptor drums 31A through 31D with pressure. Further, a detailed description of the pressing position of the intermediate transfer roller for monochrome 34A will be provided later.

In full-color image forming, the toner images undergo primary transfers sequentially from the respective photoreceptor drums 31A through 31D onto the intermediate transfer belt 41 moving toward the direction of movement C in such a manner as to be superimposed to a single toner image by the primary transfer bias applied to the intermediate transfer rollers 34A through 34D. Then, when a paper sheet passes the space between the drive roller 42 and the secondary transfer roller 50A, the toner image undergoes a secondary transfer from the intermediate transfer belt 41 onto the paper sheet by the secondary transfer bias applied to the secondary transfer roller 50A.

Figure 3:
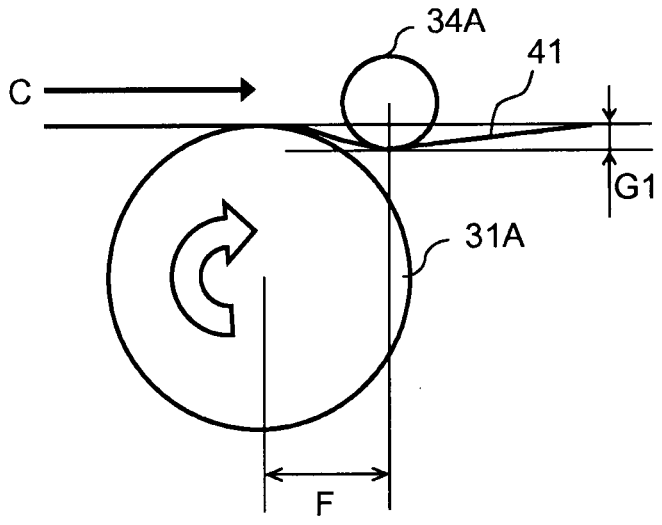
FIG. 3 is a drawing showing a relation in arrangement between the photoreceptor drum and the intermediate transfer roller other than the one on the most upstream side.

As shown in FIG. 3, in a state where the intermediate transfer rollers 34A through 34C are disposed at the respective pressing positions, nip regions between the respective intermediate transfer rollers 34A through 34C other than the intermediate transfer roller 34D (transfer member on the most upstream side) disposed on the most upstream side in the direction of movement C and the intermediate transfer belt 41 do not respectively overlap with nip regions between the photoreceptor drums 31A through 31C corresponding to the respective intermediate transfer rollers 34A through 34C and the intermediate transfer belt 41. Therefore, at the photoreceptor drums 31A through 31C, primary transfers are performed in states of low nip pressures between the respective photoreceptor drums 31A through 31C and the intermediate transfer belt 41; so that the occurrence of a transfer failure such as missing character due to the toner aggregation on the intermediate transfer belt 41 is suppressed, and hence the deterioration of image quality in a secondary transfer step is suppressed. Here, in FIG. 3, the photoreceptor drum 31A is shown as an example.

Figure 4:
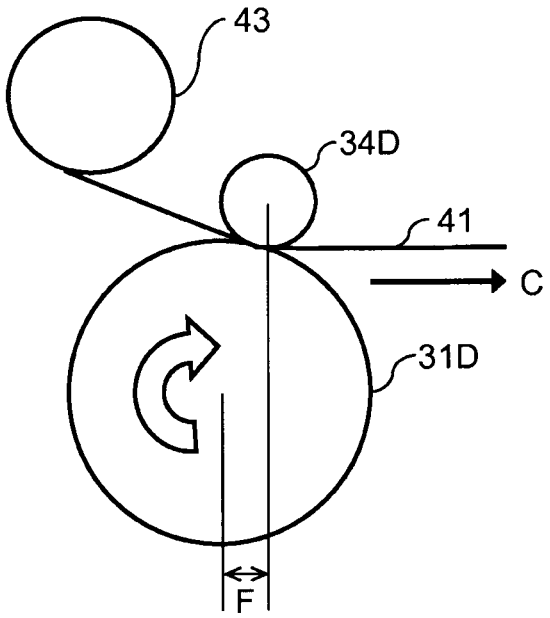
FIG. 4 is a drawing showing a relation in arrangement between the photoreceptor drum and the intermediate transfer roller on the most upstream side.

As shown in FIG. 4, in a state where the intermediate transfer roller 34D is disposed at the pressing position, a nip region between the intermediate transfer roller 34D disposed on the most upstream side in the direction of movement C and the intermediate transfer belt 41 overlaps partially at least with a nip region between the photoreceptor drum 31D disposed on the most upstream side in the direction of movement C and the intermediate transfer belt 41.

Because the intermediate transfer belt 41 comes into contact with the photoreceptor drum 31D disposed on the most upstream side in the direction of movement C from a direction inclining downward from the upstream side to the downstream side, and because a distance in the horizontal direction from the idle roller 43 is small, a degree of angle of approach of the intermediate transfer belt 41 to the photoreceptor drum 31D becomes large; however, since the respective nip regions of the intermediate transfer roller 34D and the photoreceptor drum 31D as opposed to the intermediate transfer belt 41 overlap partially at least, a nip pressure between the intermediate transfer belt 41 and the photoreceptor drum 31D can be stabilized; therefore, the occurrence of a transfer failure such as missing character due to the defective transfer of toner can be suppressed.

Here, to the photoreceptor drum 31D, a developer of a hue (yellow) in which a transfer failure is inconspicuous is supplied; so that even when a transfer failure due to the toner aggregation has occurred because of the intermediate transfer roller 34D caused to come into contact with the photoreceptor drum 31D with pressure sandwiching the intermediate transfer belt 41 in between, the transfer failure in the secondary transfer step is inconspicuous.

In this manner, the transfer device 10 makes it possible to suppress the deterioration of image quality without increasing the parts count by such as installing a roller to press the intermediate transfer belt 41 against the photoreceptor drum 31D disposed on the most upstream side separately from the intermediate transfer roller 34D, thereby preventing a cost increase. Moreover, although it is conceivable to lengthen the distance between the photoreceptor drum 31D and the idle roller 43 so as to decrease the degree of angle of approach of the intermediate transfer belt 41 to the photoreceptor drum 31D, the transfer device 10, allowing for suppressing the deterioration of image quality without lengthening the distance between the components, makes it possible to attempt downsizing of the apparatus.

Subsequently, relationships between respective offset values F of the intermediate transfer rollers 34A through 34D at the pressing positions for the photoreceptor drums 31A through 31D and image quality of respective hues are explained, referring to FIG. 5.

FIG. 5 shows an experimental result of the above-mentioned relationships when the outer diameter of the photoreceptor drums 31A through 31D is 30 mm, the outer diameter of the intermediate transfer rollers 34A through 34D is 12 mm, and the shaft diameter of the intermediate transfer rollers 34A through 34D is 8 mm. FIG. 5 shows the experimental result in full-color image forming. In FIG. 5, the mark ◎ shows that image quality was particularly good; the mark ○ shows that image quality was good; and the mark X shows that image quality was bad.

Also, in FIG. 5, in the state where the intermediate transfer rollers 34A through 34D are disposed at the respective pressing positions, a state in which the nip regions between the intermediate transfer rollers 34A through 34D and the intermediate transfer belt 41 in the direction of movement C do not overlap with the nip regions between the photoreceptor drums 31A through 31D and the intermediate transfer belt 41 is indicated as "non-contact". Further, in the state where the intermediate transfer rollers 34A through 34D are disposed at the respective pressing positions, a state in which the nip regions between the intermediate transfer rollers 34A through 34D and the intermediate transfer belt 41 in the direction of movement C overlaps partially at least with the nip regions between the photoreceptor drums 31A through 31D and the intermediate transfer belt 41 is indicated as "contact".

First, the relationships between the offset values F of the intermediate transfer rollers 34A through 34C at the pressing positions for the photoreceptor drums 31A through 31C other than the photoreceptor drum 31D on the most upstream side in the direction of movement C and image quality are explained, taking the photoreceptor drum 31A and the intermediate transfer roller 34A as an example.

As shown in FIG. 3, at the pressing position in full-color image forming, the intermediate transfer roller 34A is disposed at a position by which the intermediate transfer belt 41 is caused to be pressed against the photoreceptor drum 31A by a pressing value G1 toward a pressing direction (for example, downward). The pressing value G1 indicates a distance in the vertical direction between the top of the photoreceptor drum 31A and the bottom of the opposite intermediate transfer roller 34A, and hence represents an amount of pressing. The pressing value G1 is, for example, 1 mm. In this situation, the intermediate transfer roller 34A is disposed at a correct position by having a bearing section (not shown) of its own coming into contact with a holder member (not shown) holding the photoreceptor drum 31A.

In this case, the image quality of each hue is determined depending on the offset value F which is a distance between the rotating shaft of the photoreceptor drum 31A and the rotating shaft of the intermediate transfer roller 34A in the direction of movement C of the intermediate transfer belt 41. When the offset value F is not less than 2.0 mm and not larger than 4.0 mm, the nip regions of the intermediate transfer roller 34A and the photoreceptor drum 31A as opposed to the intermediate transfer belt 41 do not overlap in the direction of movement C of the intermediate transfer belt 41. In particular, it was possible to suppress most the occurrence of a transfer failure due to the toner aggregation on the intermediate transfer belt 41 when the offset value F was 3.0 mm.

Next, the relationship between the offset value F of the intermediate transfer roller 34D at the pressing position for the photoreceptor drum 31D disposed on the most upstream side and the image quality is explained.

As shown in FIG. 4, the intermediate transfer roller 34D is disposed at a position where it is in contact with the photoreceptor drum sandwiching the intermediate transfer belt 41 in between. The pressing value G1 is smaller as compared with the cases of the intermediate transfer rollers 34A through 34C, so that it can be considered as zero. In this situation, the intermediate transfer roller 34D is disposed at a correct position by having a bearing section (not shown) of its own coming into contact with a holder member (not shown) holding the photoreceptor drum 31D.

In this case, the image quality of the hue of yellow is determined depending on the offset value F which is a distance between the rotating shaft of the photoreceptor drum 31D and the rotating shaft of the intermediate transfer roller 34D in the direction of movement C of the intermediate transfer belt 41. When the offset value F is not less than 0.5 mm and not larger than 1.5 mm, the nip regions of the intermediate transfer roller 34D and the photoreceptor drum 31D as opposed to the intermediate transfer belt 41 overlap partially at least in the direction of movement C of the intermediate transfer belt 41. In particular, it was possible to suppress most the occurrence of a transfer failure due to the toner aggregation on the intermediate transfer belt 41 when the offset value F was 1.0 mm. Additionally, when the offset value F was 0.0 mm, a transfer irregularity due to the excessive electric charge occurred, resulting in a bad image quality.

Accordingly, from the experimental result shown in FIG. 5, the next conclusion was able to be drawn. That is, with regard to the intermediate transfer rollers 34A through 34C other than the intermediate transfer roller 34D disposed on the most upstream side in the direction of movement C, in the state thereof being disposed at the respective pressing positions, the image quality was particularly good in the state of "non-contact" where the nip regions between the intermediate transfer rollers 34A through 34C and the intermediate transfer belt 41 do not overlap with the nip regions between the photoreceptor drums 31A through 31C and the intermediate transfer belt 41. On the other hand, with regard to the intermediate transfer roller 34D disposed on the most upstream side in the direction of movement C, in the state thereof disposed at the pressing position, the image quality was particularly good in the state of "contact" where the nip region between the intermediate transfer roller 34D and the intermediate transfer belt 41 overlaps partially at least with the nip region between the photoreceptor drum 31D and the intermediate transfer belt 41.

Subsequently, configuration of the transfer member moving mechanism 20, along with the pressing positions of the intermediate transfer roller for monochrome 34A in full-color image forming and in monochromatic image forming are explained.

Figure 6A:
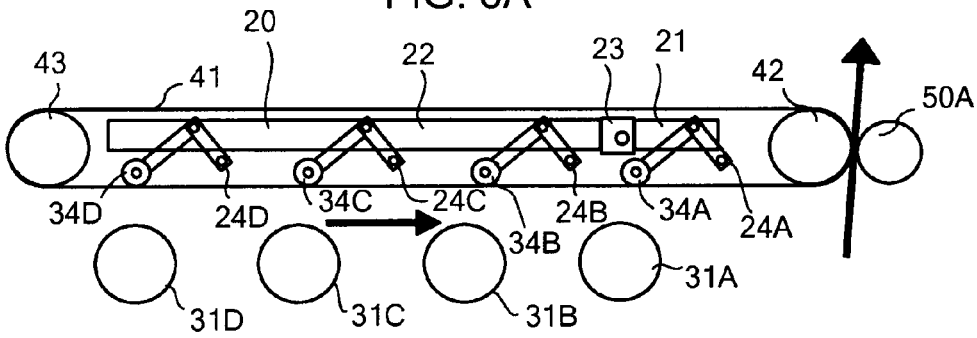
FIG. 6 is a drawing showing a configuration of a transfer member moving mechanism; with FIG. 6A showing the transfer member moving mechanism in non-image forming.
FIG. 6B showing the transfer member moving mechanism in monochromatic image forming.
FIG. 6C showing the transfer member moving mechanism in full-color image forming.
Figure 6B:
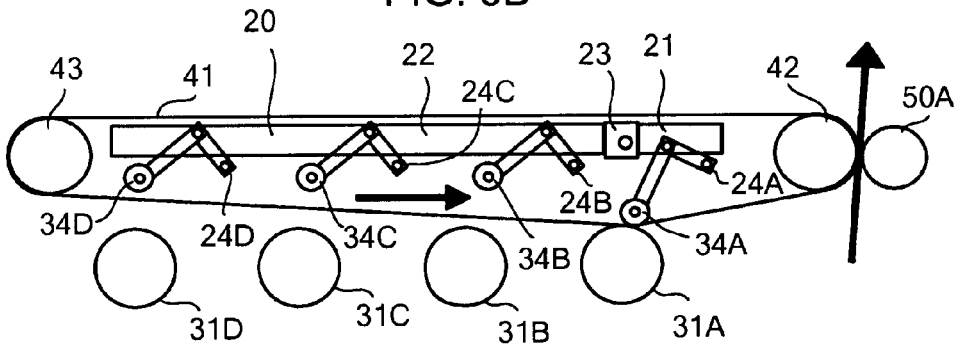
Figure 6C:
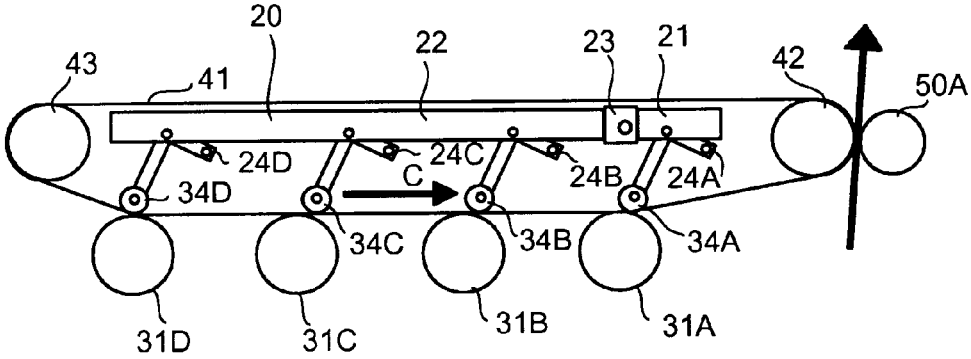
Figure 7A:
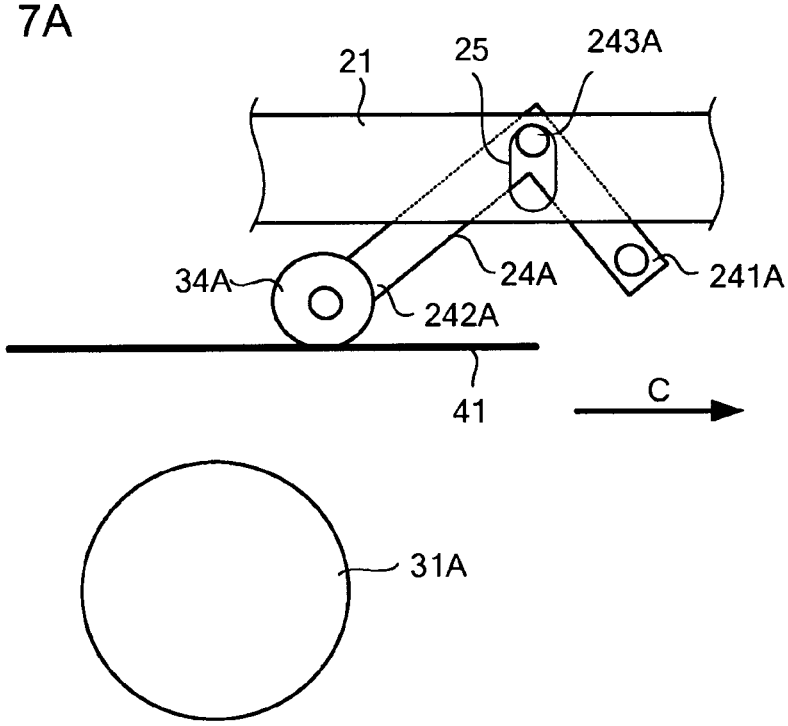
FIG. 7 is an enlarged view of a part of the transfer member moving mechanism; with FIG. 7A showing a state in which the intermediate transfer roller is at a separate position.
FIG. 7B showing a state in which the intermediate transfer roller is at a pressing position.
Figure 7B:
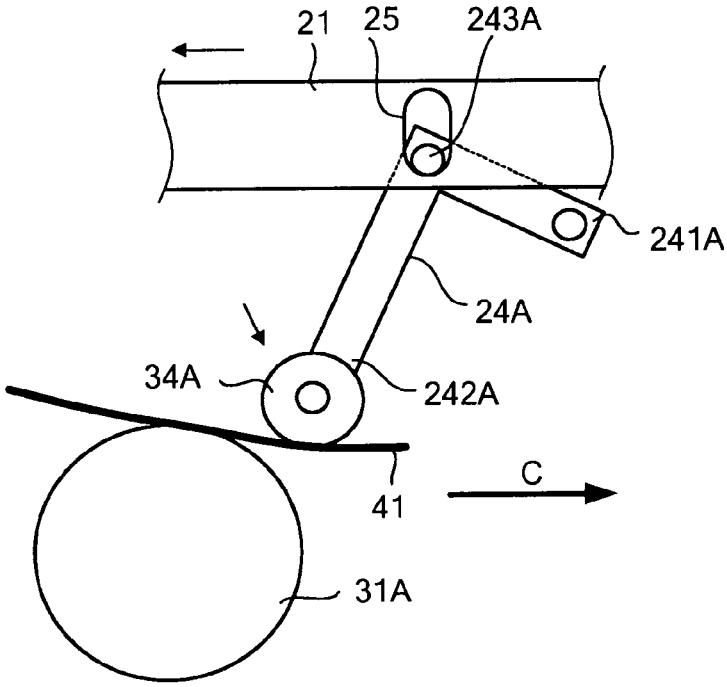

FIG. 6 shows a configuration of the transfer member moving mechanism 20; with FIG. 6A showing the transfer member moving mechanism 20 in non-image forming; FIG. 6B showing the transfer member moving mechanism 20 in monochromatic image forming; and FIG. 6C showing the transfer member moving mechanism 20 in full-color image forming.

As shown in FIG. 6A through FIG. 6C, FIG. 7A and FIG. 7B, the transfer member moving mechanism 20 includes a first link member 21, a second link member 22, a cam 23, and a first to fourth arms 24A, 24B, 24C, 24D.

The first to fourth arms 24A through 24D each give an L-shape. The second to fourth arms 24B through 24D are configured in the same manner as the first arm 24A. A first end portion 241A of the first arm 24A is rotatably supported by a frame, which is not illustrated, of the intermediate transfer belt unit 40. A second end portion 242A of the first arm 24A rotatably supports the intermediate transfer roller 34A. Likewise, second end portions of the second to fourth arms 24B through 24D rotatably support the intermediate transfer rollers 34B through 34D.

The first link member 21 has a lengthwise slit 25 at a position corresponding to the first arm 24A. The second link member 22 has lengthwise slits at positions corresponding to the respective second to fourth arms 24B through 24D.

The first arm 24A has at a bent thereof a protruding portion 243A projecting in a direction of the rotating shaft of the intermediate transfer roller 34A. The protruding portion 243A is displaced in the slit 25 of the first link member 21. The protruding portions of the second to fourth arms 24B through 24D are displaced in the respective slits of the second link member 22.

Therefore, when the first link member 21 moves toward the upstream side in the direction of movement C of the intermediate transfer belt 41, the protruding portion 243A is caused to descend in the slit 25; and then the intermediate transfer roller 34A is caused to move downward to the pressing position. This causes the intermediate transfer belt 41 to be pressed against the photoreceptor drum 31A. On the other hand, when the first link member 21 moves toward the downstream side in the direction of movement C, the protruding portion 243A is caused to ascend in the slit 25; and then the intermediate transfer roller 34A is caused to move upward to the separate position. This causes the intermediate transfer belt 41 to be separate from the photoreceptor drum 31A.

Similarly, the intermediate transfer rollers 34B through 34D are caused to move downward to the respective pressing positions when the second link member 22 moves toward the upstream side in the direction of movement C, and are caused to move upward to the respective separate positions when the second link member 22 moves toward the downstream side in the direction of movement C.

Figure 8A:
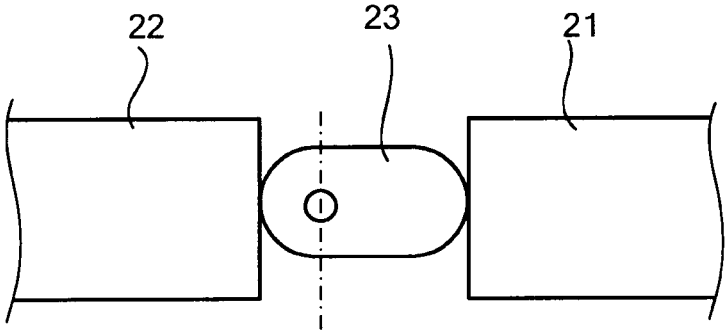
FIG. 8 is an enlarged view of another part of the transfer member moving mechanism; with FIG. 8A showing the transfer member moving mechanism in non-image forming.
FIG. 8B showing the transfer member moving mechanism in monochromatic image forming.
FIG. 8C showing the transfer member moving mechanism in full-color image forming.
Figure 8B:
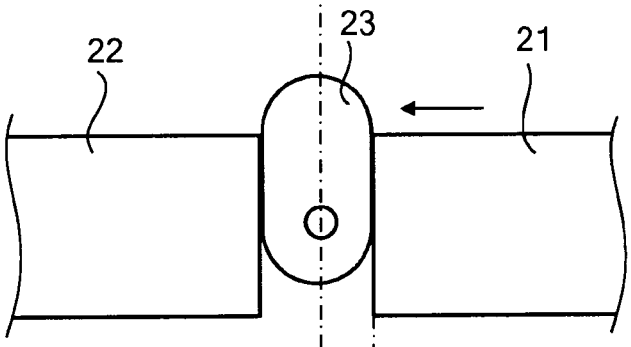
Figure 8C:
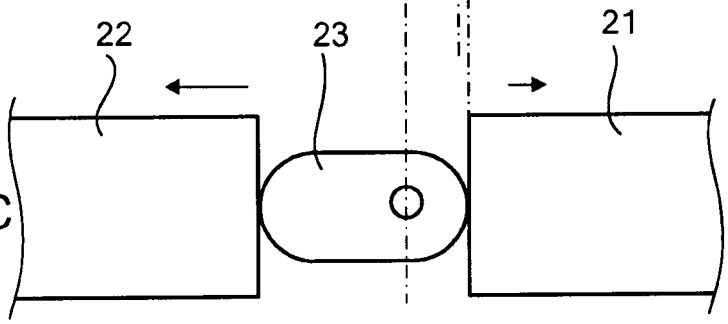

FIG. 8A, FIG. 8B, and FIG. 8C show the transfer member moving mechanism in non-image forming, in monochromatic image forming, and in full-color image forming, respectively.

As shown in FIG. 8A through FIG. 8C, the cam 23 consists of an eccentric cam. The cam 23 is configured in such a manner that in the state of arrangement in non-image forming shown in FIG. 8A the distance between its rotating shaft and right side edge is the largest, that the distance between its rotating shaft and upper side edge and the distance between its rotating shaft and left side edge are second largest, and that the distance between its rotating shaft and the lower side edge is the smallest.

The distance between the rotating shaft and the upper side edge and the distance between the rotating shaft and the left side edge is the same. The first link member 21 and the second link member 22 are respectively urged toward the cam 23's side.

As shown in FIG. 8A, in non-image forming, the cam 23 is disposed in a first direction. This causes the first link member 21 and the second link member 22 to be disposed together on the downstream side in the direction of movement C, thereby causing the intermediate transfer rollers 34A through 34D to be disposed at the separate positions.

Figure 9A:
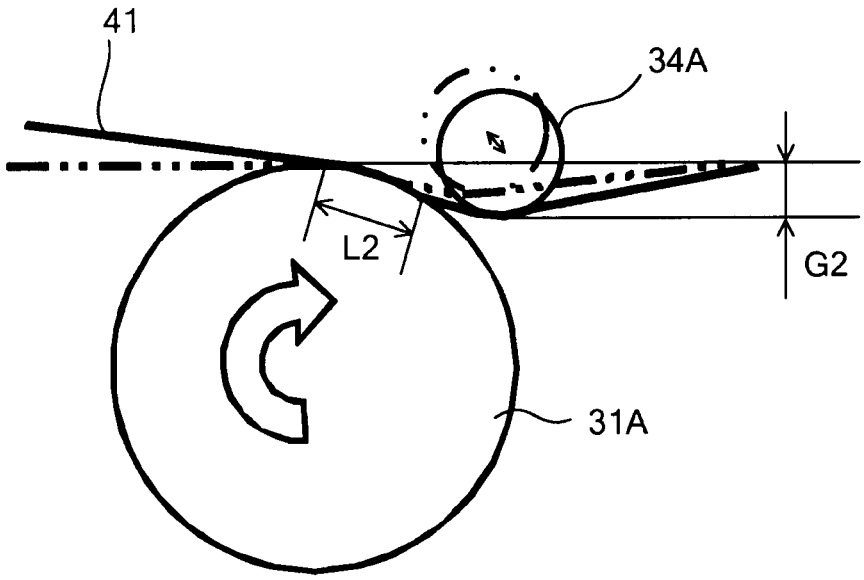
FIG. 9 is a drawing showing a relation in arrangement between the photoreceptor drum and the intermediate transfer roller for monochrome disposed on the most downstream side; with FIG. 9A showing the relation in arrangement in monochromatic image forming.
FIG. 9B showing the relation in arrangement in full-color image forming.

As shown in FIG. 8B, in monochromatic image forming, the cam 23 is disposed in a second direction revolved counterclockwise by an angle of 90 degrees in FIG. 8B as compared with the non-image forming case. This causes the first link member 21 to be disposed on the upstream side in the direction of movement C, thereby causing the intermediate transfer roller 34A to be disposed at a second pressing position as shown by a solid line in FIG. 9A. The second link member 22 remains disposed on the downstream side in the direction of movement C, thereby causing the intermediate transfer rollers 34B through 34D to be disposed at the separate positions. Additionally, a dashed line in FIG. 9A shows, for ease of comparison, positions of the intermediate transfer roller 34A and the intermediate transfer belt 41 in full-color image forming shown in FIG. 9B.

Figure 9B:
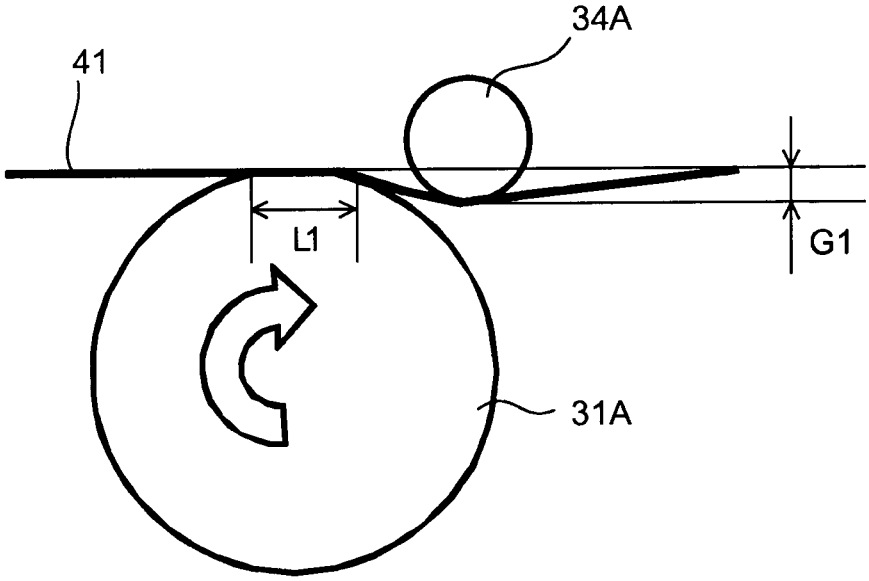

As shown in FIG. 8C, in full-color image forming, the cam 23 is disposed in a third direction revolved by an angle of 180 degrees in FIG. 8C as compared with the non-image forming case. This causes the first link member 21 and the second link member 22 to be disposed together on the upstream side in the direction of movement C, and thus causing the intermediate transfer roller 34A to be disposed at a first pressing position as shown in FIG. 9B. The intermediate transfer rollers 34B through 34D are caused to be disposed at the respective pressing positions.

As shown in FIG. 8B and FIG. 8C, by comparison between the monochromatic image forming and full-color image forming, the first link member 21 is disposed on further upstream side in monochromatic image forming than in full-color image forming. This causes the second pressing position of the intermediate transfer roller for monochrome 34A in monochromatic image forming to be different from the first pressing position of the intermediate transfer roller for monochrome 34A in full-color image forming, thereby making the pressing value G2 of the intermediate transfer belt 41 by the intermediate transfer roller for monochrome 34A in monochromatic image forming greater than the pressing value G1 of the intermediate transfer belt 41 by the intermediate transfer roller for monochrome 34A in full-color image forming.

The first pressing position and the second pressing position are set so that a nip width L1 between the intermediate transfer belt 41 and the photoreceptor drum for monochrome 31A in full-color image forming and a nip width L2 between the intermediate transfer belt 41 and the photoreceptor drum for monochrome 31A in monochromatic image forming have an equal value.

Figure 10:
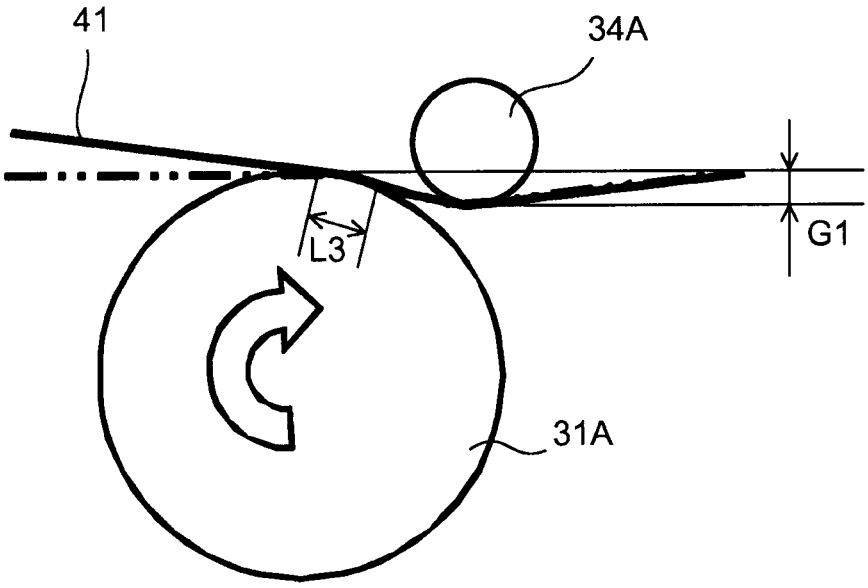
FIG. 10 is a drawing showing a comparative example of a relation in arrangement between the photoreceptor drum and the intermediate transfer roller for monochrome disposed on the most downstream side in full-color image forming and in monochromatic image forming.

Accordingly, as shown in FIG. 10, the nip width L2 between the intermediate transfer belt 41 and the photoreceptor drum for monochrome 31A in monochromatic image forming in the transfer device 10 becomes larger as compared with the nip width L3 between the intermediate transfer belt 41 and the photoreceptor drum for monochrome 31A in the configuration where the pressing positions of the intermediate transfer roller for monochrome 34A in full-color image forming and in monochromatic image forming are the same.

Therefore, the image forming apparatus 100 provided with the transfer device 10 makes it possible to form a monochromatic image of equal image quality in monochromatic image forming and in full-color image forming.

Additionally, as described above, the rotating shafts of the intermediate transfer rollers 34A through 34D are disposed at positions on the downstream sides of the rotating shafts of the respective opposite photoreceptor drums 31A through 31D in the direction of movement C of the intermediate transfer belt 41. The reason for this is as follows. That is, it is conceivable to dispose the rotating shafts of the intermediate transfer rollers 34A through 34D at positions on the upstream sides of the rotating shafts of the respective opposite photoreceptor drums 31A through 31D in the direction of movement C of the intermediate transfer belt 41. However, when the rotating shafts of the intermediate transfer rollers 34A through 34D are disposed at positions on the upstream sides of the rotating shafts of the respective opposite photoreceptor drums 31A through 31D, scattering of the toner images may occur in minute spaces between the intermediate transfer belt 41 and the toner images on the photoreceptor drums 31A through 31D. Therefore, the rotating shafts of the intermediate transfer rollers 34A through 34D are made to locate at the downstream sides of the rotating shafts of the photoreceptor drums 31A through 31D; and this makes sure that the electric charge is applied to each of the toner images borne by the photoreceptor drums 34A through 34D after the nip pressure has built up, thereby suppressing the deterioration of the quality of a transferred image.

Further, although toners consisting of four-color hues are used in the above embodiment, the deterioration of image quality can be suppressed also when the present invention is applied to a configuration using toners consisting of multi-color hues such as six colors or eight colors. In such a case, it is preferred that a photoreceptor drum to which a developer of a hue in which a transfer failure is most inconspicuous is supplied is disposed on the most upstream side.

Moreover, the transfer member moving mechanism 20 is not limited to being configured in such a manner as to move the intermediate transfer rollers 34A through 34D in the vertical direction perpendicular to the direction of movement C of intermediate transfer belt 41. As long as the transfer member moving mechanism 20 is capable of moving the intermediate transfer rollers 34A through 34D between the pressing positions to cause the intermediate transfer belt 41 to be pressed against the respective plurality of photoreceptor drums 31A through 31D and the separate positions to cause the intermediate transfer belt 41 to be separate from the respective plurality of photoreceptor drums 31A through 31D, the direction in which the intermediate transfer rollers 34A through 34D are caused to move may be, for example, in a direction other than the direction perpendicular to the direction of movement C, as shown in FIG. 9A.

The above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

REFERENCE SIGNS LIST

10 transfer device
20 transfer member moving mechanism
30A-30D image forming station
31A-31D photoreceptor drum (image bearing member)
34A-34D intermediate transfer roller (transfer member)
40 intermediate transfer belt unit
41 intermediate transfer belt (endless belt)
50 secondary transfer unit
50A secondary transfer roller
C direction of movement

The invention claimed is:

1. A transfer device in which an outer circumferential surface of an endless belt moving along a predetermined loop-like path of movement is disposed so as to face a plurality of image bearing members including one image bearing member for monochrome and one or more image bearing members for color that bear developer images of mutually different hues and are aligned with each other, the transfer device comprising:

the endless belt;

a plurality of transfer members that are disposed so as to be opposed to the respective plurality of image bearing members across the endless belt on respective downstream sides of the plurality of image bearing members in a direction of movement of the endless belt and that sequentially transfer developer images borne by the respective plurality of image bearing members onto the endless belt; and a transfer member moving mechanism that moves the plurality of transfer members between pressing positions to cause the endless belt to be pressed against the respective plurality of image bearing members and separate positions to cause the endless belt to be separate from the respective plurality of image bearing members, the transfer member moving mechanism arranging a transfer member for monochrome corresponding to the image bearing member for monochrome and transfer members for color corresponding to the image bearing members for color at the respective pressing positions in full-color image forming, and arranging the transfer member for monochrome at the pressing position and the transfer members for color at the separate positions in monochromatic image forming, the transfer member moving mechanism including:

a first link member which has a first slit long in a direction perpendicular to the direction of movement of the endless belt and of which movement toward the upstream side in the direction of movement of the endless belt causes the transfer member for monochrome to move to the pressing position and of which movement toward the downstream sides causes the transfer member for monochrome to move to the separate position;

a second link member which has one or more second slits along in the direction perpendicular to the direction of movement of the endless belt and of which movement toward the upstream side in the direction of movement of the endless belt causes the transfer members for color to move to the pressing positions and of which movement toward the downstream side causes the transfer members for color to move to the separate positions;

an eccentric cam which is disposed between the first link member and the second link member and with which the first link member and the second link member are in contact with pressure; and a plurality of arms each of which gives a L-shape with a first end portion thereof rotatably supported by a frame and a second end portion thereof rotatably supporting each of the plurality of transfer member and has at a bent thereof a protruding portion that is displaced in the first slit or the second slit, wherein the transfer member moving mechanism causes a second pressing position of the transfer member for monochrome in monochromatic image forming to be different from a first pressing position of the transfer member for monochrome in full-color image forming so that an amount of pressing of the endless belt by the transfer member for monochrome becomes greater in monochromatic image forming than in full-color image forming.

2. The transfer device as claimed in claim 1 wherein the image bearing member for monochrome is disposed on the most downstream side in the direction of movement of the endless belt among the plurality of image bearing members.

3. The transfer device as claimed in claim 1, wherein, in a state where the plurality of transfer members are disposed at the respective pressing positions, a nip region between the most upstream side transfer member disposed on the most upstream side in the direction of movement of the endless belt among the plurality of transfer members and the endless belt overlaps partially at least with a nip region between the image bearing member disposed on the most upstream side in the direction of movement of the endless belt among the plurality of image bearing members and the endless belt; and nip regions between the transfer members other than the most upstream side transfer member among the plurality of transfer members and the endless belt and nip regions between the image bearing members corresponding to the respective transfer members other than the most upstream side transfer member and the endless belt do not overlap.

* * * * *